United States Patent [19]

Teng

[11] Patent Number: 5,065,289

[45] Date of Patent: Nov. 12, 1991

[54] DISPLAY DEVICE HAVING MAGNIFYING AND CONTRACTING IMAGES

[76] Inventor: Hsieh-Yi Teng, c/o Hung Hsing Patent Service Center P.O. Box 55-1670, Taipei, Taiwan, 10477

[21] Appl. No.: 615,344

[22] Filed: Nov. 19, 1990

[51] Int. Cl.[5] ..... F21V 33/00

[52] U.S. Cl. ..... 362/101; 362/253; 362/269; 362/285; 362/808

[58] Field of Search ..... 362/806, 808, 101, 96, 362/809, 122, 32, 283, 282, 281, 269, 371, 285, 253; 40/493

[56] References Cited

U.S. PATENT DOCUMENTS

| | | | |
|---|---|---|---|
| 1,681,040 | 8/1928 | Kemp | 362/101 |
| 3,431,409 | 3/1969 | Richter, III et al. | 362/808 |
| 3,694,648 | 9/1972 | Yates | 362/808 |
| 4,170,035 | 10/1979 | Walker | 362/96 |
| 4,771,902 | 9/1988 | Teng | 362/101 |

*Primary Examiner*—Ira S. Lazarus
*Assistant Examiner*—Sue Hagarman

[57] ABSTRACT

A display device includes: a crystal ball fixed on a base formed with plural concave and convex portions on a spherical surface of the crystal ball to respectively form plural concave lens and convex lens on the ball surface when filled with water in the ball, thereby producing magnified and contracted images for a decorative article mounted in the ball as viewed through the concave and convex portions for enhancing decorative interest.

4 Claims, 4 Drawing Sheets

DISPLAY DEVICE HAVING MAGNIFYING AND CONTRACTING IMAGES

BACKGROUND OF THE INVENTION

A conventional water ball such as disclosed in U.S. Pat. No. 4,757,986 generally includes a spherical ball for providing a toy 3 inside the ball 1 which may be rotatable to increase its vividness. However, the ball is spherical shaped and would not produce diversified images such as a magnifying or a contracting image when viewing the toy 3, thereby still limiting its decorative effect.

The present inventor has found the defects of a conventional water ball and invented the present display device capable of exerting magnified and contracted images for a decorative article formed inside the device.

SUMMARY OF THE INVENTION

The object of the present invention is to provide a display device including a crystal ball fixed on a base formed with concave and convex portions on a spherical surface of the ball to respectively form plural concave lens and convex lens on the ball surface when filled with water in the ball, thereby producing magnifying and contracting images for a decorative article mounted inside the ball as viewed from several directions through the concave and convex portions of the ball for enhancing decorative interest and increasing diversified features.

DETAILED DESCRIPTION

Figure 1:
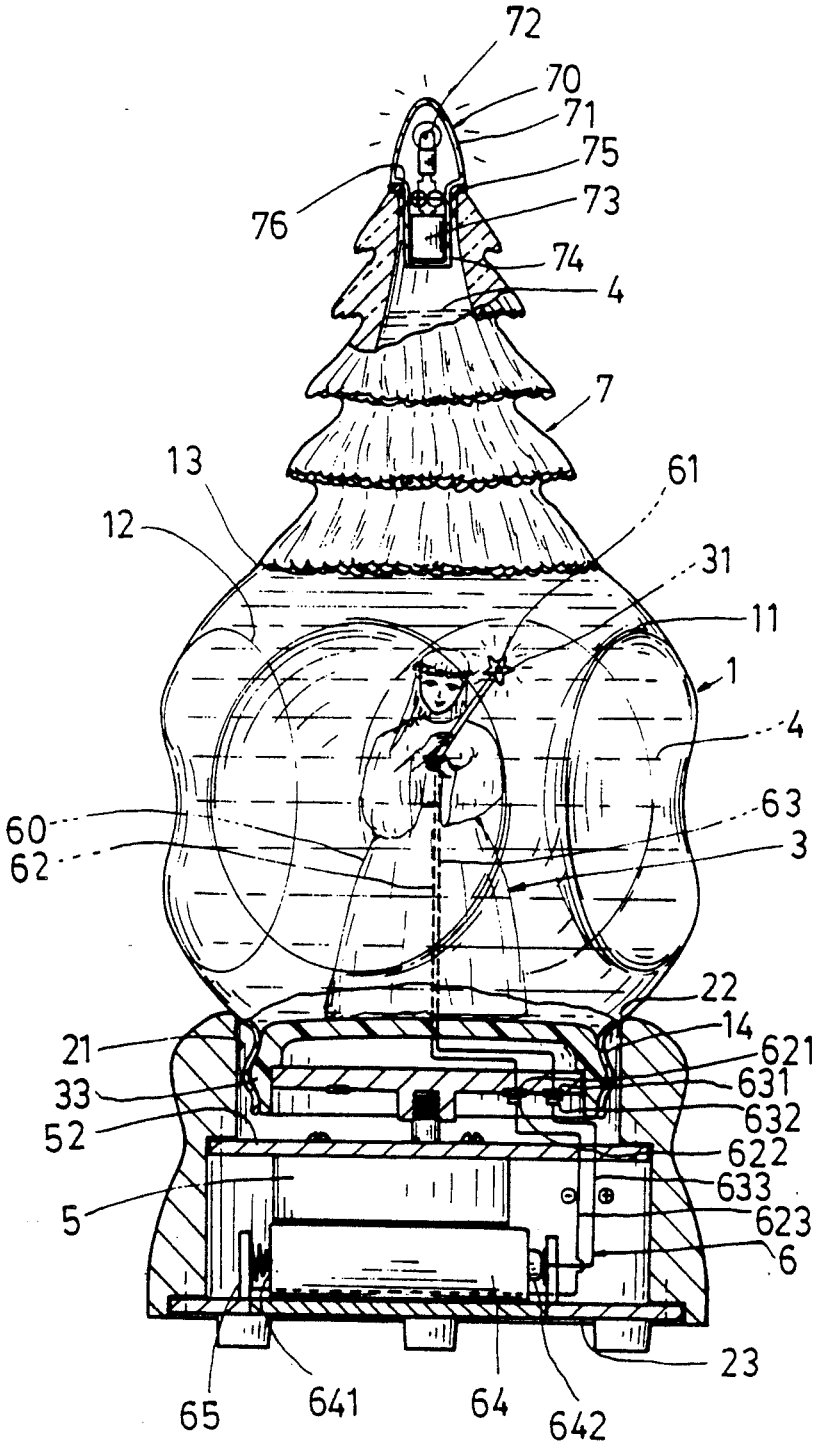
FIG. 1 is an illustration having a partial cut-away portion of the present invention.
Figure 2:
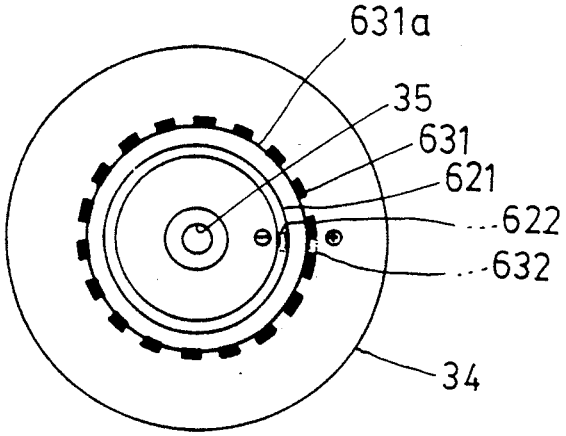
FIG. 2 is a bottom view of a supporting disk of the present invention.

As shown in FIGS. 1, 2, the present invention comprises: a crystal ball 1, a base 2, an inner decorative means 3, a liquid water 4 filled in the ball 1, a driving means 5, an illuminating means 6, and an upper decorative means 7.

The crystal ball 1 generally formed as spherical shape or other shapes and formed as transparent includes: a plurality of concave portions 11 formed in a spherical surface of the ball 1, a plurality of convex portions 12 formed on the spherical surface of the ball 1 each convex portion 12 being disposed around by a plurality of concave portions 11, an upper portion 13 secured with or integrally formed with the upper decorative means 7, and a neck portion 14 formed on a lower portion of the ball 1.

The base 2 includes: a central hole 21 formed through the base 2, an annular extension 22 formed on a top portion of the base 2 for rotatably supporting a lower portion of the ball 1, and a bottom plate 23 fixed on a bottom portion of the base 2.

The inner decorative means 3 includes: a middle bulb shade 31 made with transparent material formed on a suitable portion of a decorative feature 30 such as a star (31) carried by an angel (30) as shown in FIG. 1, a packing disk 32 for mounting the decorative feature 30 thereon having a periphery extension 33 sealably engageable with an opening in the neck portion 14 of the ball 1, and a supporting disk 34 secured to the packing disk 33 having a central bottom stem 35 mounted on a shaft 51 of the driving means 5.

The driving means 5 may be secured inside the base 2 by fixing screws on a fixing plate 52 of the means 5. The driving means 5 may be selected from a spring system of a musical box and an electric motor.

The illuminating means 6 includes: a middle bulb 61 held in the shade 31, and two wires 62, 63 electrically connecting the bulb 61 to a power source 64 such as a dry battery secured in a battery socket 65 formed in the base or secured on the plate 23 as shown in FIG. 1.

Figure 7:
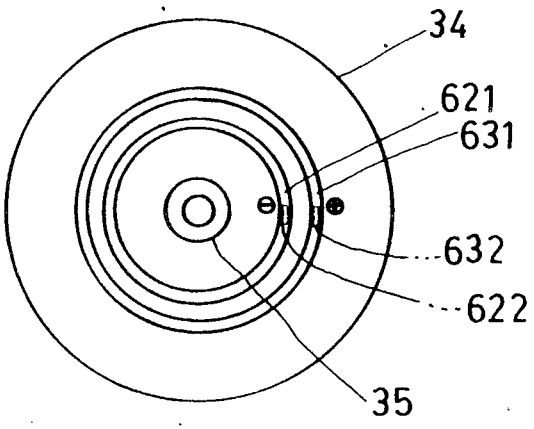
FIG. 7 shows another supporting disk of the present invention.

As shown in FIGS. 2, 7 and 1, the two wires 62, 63 are respectively connected to upper annular contactors 621, 631 concentrically formed on a bottom of the disk 34 as shown in full line or dotted line in the FIGS. 7, 2. Two lower stationary contactors 622, 632 are frictionally rotatably contacted with the two upper contactors 621, 631, and are respectively connected to two poles 641, 642 of the power source 64 through two lower wires 623, 633. Other modifications of the illuminating means 6 and its power connection can be made in this invention. The annular contactor 631 includes a plurality of electrically conductive dots intermittently formed along a conductive circle line 631*a* concentric to the annular contactor 621 as shown in FIG. 2 for flashing the bulb 61 when rotating the ball, the decorative feature 3 and the disk 34 around the shaft 51.

The upper decorative means 7 includes: an upper decorative article formed or integrally formed on the upper portion 13 of the ball 1 such as a Christmas tree, a bear, a pine fruit cone, and a star as shown in FIGS. 1, 4, 5 and 6 respectively; and a top plug 70 sealing a top opening 76 formed on a top portion of the decorative means 7 by packing 75 for filling water 4 into the ball 1 when removing the plug 70.

The top plug 70 includes: an upper bulb shade 71, a top bulb 72 formed in the shade 71 electrically connected to a power source 73, and a lower plug portion 74 inserted in the top opening 76 by the packing 75.

In using the present invention, the water is filled into the ball 1 through the top opening 76. The top bulb 72 may be lit to illuminate the top plug 70.

The ball 1 may be held and rotated about the base 2 to store elastic energy of a spring system of a musical box of the driving means 5. Then the base 2 is laid on a table surface to rotate the ball 1, and the decorative means 3, 7 about the shaft 51. The middle bulb 61 will be flashed as intermittent contact between the upper dotted contactor 631 and the lower contactor 632 (another upper contactor 621 always contacting another lower contactor 622). If the contactors 621, 631 are all full lines as shown in FIG. 7, the bulb 61 will be continously lit, unless switching off the power source 64.

Figure 3:
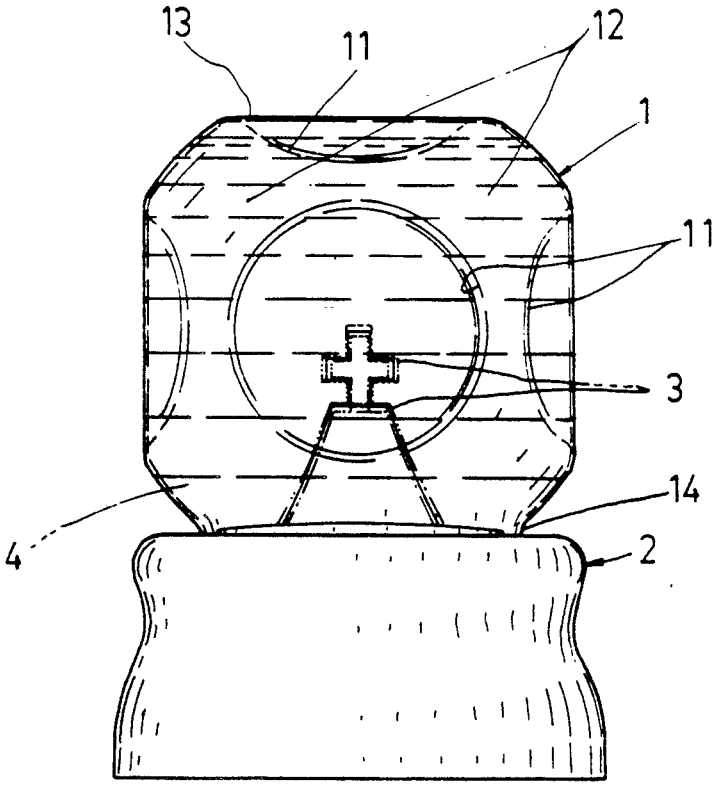
FIG. 3 shows another preferred embodiment of the present invention.
Figure 4:
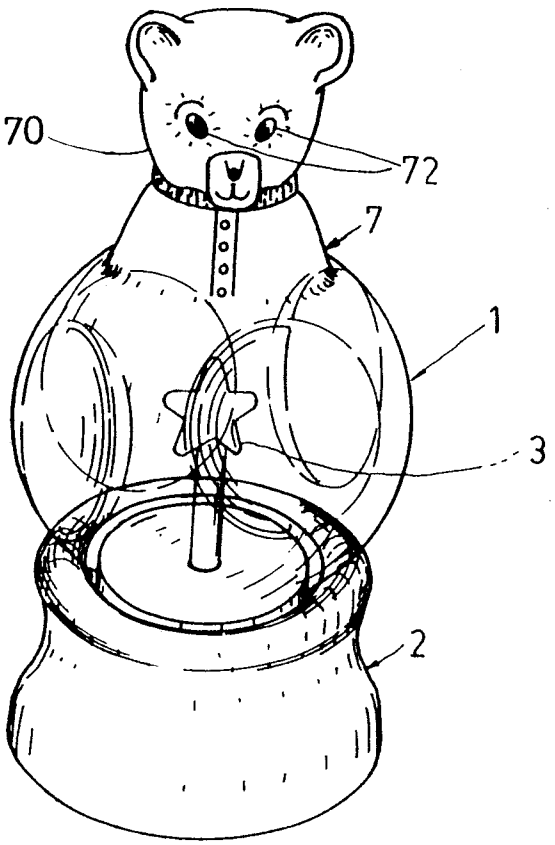
FIG. 4 shows still another preferred embodiment of the present invention.
Figure 5:
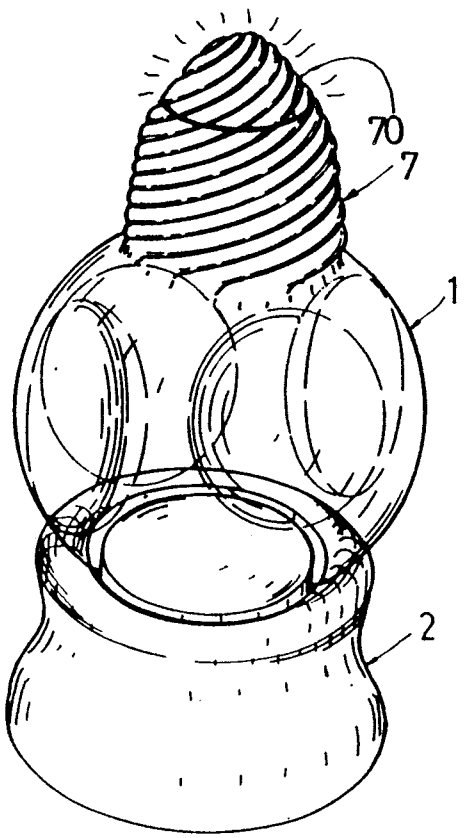
FIG. 5 is an illustration showing further embodiment of the present invention.
Figure 6:
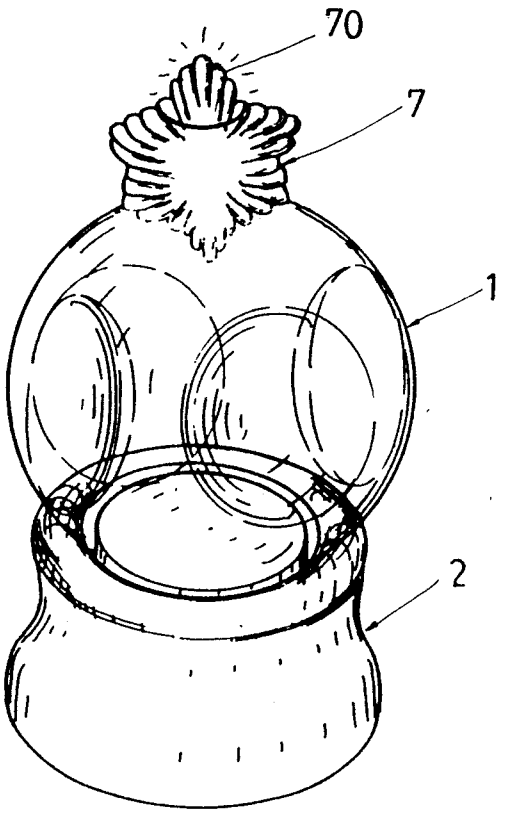
FIG. 6 shows still further embodiment of the present invention.

The present invention may also be modified to be a simple concave and convex ball 1 fixed on a base 2 as shown in FIG. 3. Naturally, the illuminating means 6 and the driving means 5 may also be eliminated for saving cost.

The present invention is fantastic because a magnified image can be viewed through the convex portion 12 and a contracted images can be viewed from the concave portion 11 when filling water 4 into the ball 1 for enhancing decorative interest.

The shape, size and and numbers of the concave portions 11 or convex portions 12 are not limited in this invention. The structure, shape of the ball 1 and the upper decorative means 7 are also not limited in this invention.

I claim:

1. A display device comprising:

a crystal ball made of transparent material having a plurality of concave portions and a plurality of convex portions respectively formed on a surface of said crystal ball, each said convex portion surrounded by a plurality of said concave portions adjacent to said convex portion;

a base having a central hole for mounting a neck portion formed on a lower portion of said crystal ball and an annular extension formed on a top portion of said base for rotatably supporting said crystal ball;

an inner decorative means held in said crystal ball having a decorative feature mounted on a packing disk sealing an opening of said neck portion of said crystal ball and having a first bulb shade formed on said decorative feature;

a driving means selected from a spring system of a musical box and an electric motor fixed in said base having a shaft for rotating said disk of said decorative feature and said ball; an illuminating means having a first bulb held in said first bulb shade electrically connected to a power source for illuminating said first bulb;

an upper decorative means integrally formed on an upper portion of said crystal ball having a top plug removably sealing a top opening formed in said upper decorative means; and water filled in said crystal ball through said top opening when removing said top plug for forming a concave lens at each said concave portion and a convex lens at each said convex portion capable of forming a contracted image and a magnified image of said decorative feature of said inner decorative means when respectively viewed from each said concave portion and said convex portion.

2. A display device according to claim 1, wherein said packing disk is fixed on a supporting disk, said supporting disk having a central bottom stem mounted on said shaft of said driving means and having two upper annular contactors concentrically formed on a bottom of said supporting disk for rotatably contacting two lower stationary contactors formed under said supporting disk, said two lower stationary contactors respectively connected to two poles of said power source formed in said base, said two upper annular contactors electrically connected to said first bulb.

3. A display device according to claim 2, wherein one of the two said upper annular contactors includes a plurality of electrically conductive dots intermittently formed along a conductive circle line formed on said supporting disk, whereby upon a rotation of said supporting disk and said ball around said shaft of said driving means fixed in said base, said first bulb will be flashed by an intermittent electrical connection between said first bulb and said power source.

4. A display device according to claim 1, wherein said top plug of said upper decorative means includes: a second bulb shade, a second bulb formed in said second shade electrically connected to a second power source, and a lower plug portion inserted in said top opening formed on an upper portion of said upper decorative means and said ball as packed by a packing.

* * * * *